US006574165B2

(12) United States Patent
Sharma et al.

(10) Patent No.: US 6,574,165 B2
(45) Date of Patent: Jun. 3, 2003

(54) MEDICATION COMPLIANCE APPARATUS

(76) Inventors: Rajiv Sharma, 18 Brands Hill Avenue, High Wycombe, Buckinghamshire H13 5QA (GB); Sunanda Sharma, 18 Brands Hill Avenue, High Wycombe, Buckinghamshire H13 5QA (GB)

( * ) Notice: Subject to any disclaimer, the term of this patent is extended or adjusted under 35 U.S.C. 154(b) by 0 days.

(21) Appl. No.: 09/879,855

(22) Filed: Jun. 12, 2001

(65) Prior Publication Data

US 2002/0118604 A1 Aug. 29, 2002

(30) Foreign Application Priority Data

Feb. 28, 2001 (GB) ..... 0104911
Mar. 22, 2001 (GB) ..... 0107190

(51) Int. Cl.[7] ..... G04B 47/00; G07F 11/00
(52) U.S. Cl. ..... 368/10; 221/2
(58) Field of Search ..... 368/10; 221/2, 221/3, 15

(56) References Cited

U.S. PATENT DOCUMENTS

| | | | | | |
|---|---|---|---|---|---|
| 3,722,739 | A | | 3/1973 | Blumberg | 221/3 |
| 4,148,273 | A | | 4/1979 | Hollingsworth et al. | 116/325 |
| 4,483,626 | A | * | 11/1984 | Noble | 368/10 |
| 5,157,640 | A | * | 10/1992 | Backner | 368/10 |
| 5,221,024 | A | | 6/1993 | Campbell | 221/3 |
| 5,289,157 | A | * | 2/1994 | Rudick | 340/309.15 |
| 5,337,290 | A | * | 8/1994 | Ventimiglia | 368/10 |
| 5,408,443 | A | * | 4/1995 | Weinberger | 368/10 |
| 5,646,912 | A | * | 7/1997 | Cousin | 368/10 |
| 5,802,014 | A | * | 9/1998 | Danko | 368/10 |
| 5,950,632 | A | | 9/1999 | Reber et al. | 128/898 |
| 6,075,755 | A | * | 6/2000 | Zarchan | 368/10 |
| 6,145,697 | A | * | 11/2000 | Gudish | 221/3 |
| 6,163,736 | A | * | 12/2000 | Halfacre | 700/232 |
| 6,169,707 | B1 | * | 1/2001 | Newland | 368/10 |
| 6,324,123 | B1 | * | 11/2001 | Durso | 368/10 |

FOREIGN PATENT DOCUMENTS

| | | |
|---|---|---|
| GB | 2288040 | 10/1995 |
| WO | 9938052 | 7/1999 |

OTHER PUBLICATIONS

Search Report of GB 0107190.1 Aug. 15, 2001.

* cited by examiner

*Primary Examiner*—David Martin
*Assistant Examiner*—Michael L. Lindinger
(74) *Attorney, Agent, or Firm*—Robert W J Usher

(57) ABSTRACT

An apparatus for reminding individuals when to take a medication, in a first embodiment 10 is a mechanical timer with different varieties of pegs 18 disposed to ring an alarm when a medication is to be taken and indicative of the medication by their style. A second embodiment 10A actually dispenses the medication that is required at that time. A third embodiment 56 is in the form of a wrist watch and displays 64 the medication and (any caveats) that is to be taken. A fourth embodiment 56A is pre-programmed so that the patient cannot tamper with the settings. The invention is apt for multi-medication multi-dose time situations.

15 Claims, 7 Drawing Sheets

MEDICATION COMPLIANCE APPARATUS

The present invention relates to multiple medication regimes where a patient or experimental subject is required to take multiple doses of medication, at intervals, there perhaps being more than one medication involved in the multiple doses. The present invention, particularly, relates to apparatus to ensure that the patient takes the correct medication at the correct time.

Very rarely, except, perhaps, for a single injection, does a patient receive a single medication in a single dose. More usually, the patient is given a course of tablets, or liquid medicine, to be taken over a course of days, months, or, perhaps, to the end of life. As patients age, the number of ailments increases and the number of medicines, and spaced doses, increases. There is a very real risk, documented in the medical literature, of compliance difficulties because of confusion over dosage schedules. The risk of multiple dosing, or of nil dosing, is ever present. Imperfect recollection can mean that, although a patient has remembered it is time to take a pill, he or she has forgotten to bring the pills. Compliance difficulties occur even when alert young adults are required to take one or two antibiotic tablets per day over a number of weeks, but are particularly significant in the elderly and in psychiatric disorders. The present invention seeks to provide an apparatus to overcome the problems of absent mindedness and forgetfulness.

In medical trials, subjects are tested to find the effect of medication. The statistical reliability of the trial is much improved if there exists a high probability that the subjects take their medication, as directed. The present invention seeks to provide an apparatus which assists in such a scheme.

Where multiple medications are required, a "Dosette" (TM) box is the most commonly currently used method for facilitating compliance. It is a box, divided into compartments, each compartment storing the medication for a particular day. The patient still has to remember when to take each medication, and under what circumstances. The present invention seeks to provide improvement over such daily dosing schemes.

Daily dose bubble packs can also be provided. The patient still has to remember to take the medication from each bubble pack, and when to take it. The invention aspires to improve over this method.

According to a first aspect, the present invention consists in an apparatus for organising the taking of medication, said apparatus comprising: clock means, for keeping track of the passage of time; selection means, for selecting a time when a medication is to be taken; alarm means, for alerting a user when said clock reaches said selected time; and indication means, for identifying the medication to be taken.

The first aspect of the invention, further, provides an apparatus wherein the medication can be one of a plurality of medications, wherein the selected time can be one of a plurality of selected times, and wherein the indication means can be operative to identify which medication or medications is or are to be taken at each instance of operation of the alarm means.

The first aspect of the invention, further, provides an apparatus wherein the indication means can include dispensing means, operative to deliver the medication to be taken at the operation of the alarm means.

The first aspect of the invention, further, provides an apparatus wherein the dispensing means can be operative to retain medication that is not taken at the selected time.

The first aspect of the invention, further, provides an apparatus, wherein the clock means can be mechanical or electro-mechanical.

The first aspect of the invention, further, provides an apparatus wherein the selection means can comprise peg holes, each for the insertion of a peg to select its respective time, and wherein the indication means can comprise a plurality of different styles of pegs, the style of peg, employed to select a particular time, being indicative of the medication to be taken at that respective time.

The first aspect of the invention, further, provides an apparatus wherein the indication means can be operative to accept a plurality of different styles of peg to select any one particular time.

The first aspect of the invention, further, provides an apparatus wherein the clock means is electronic.

The first aspect of the invention, further, provides an apparatus which can comprise a memory for holding information about a medication and a time or times for taking that medication, and where the indication means can comprise a display for displaying the information when the time arrives to take the medication.

The first aspect of the invention, further, provides an apparatus wherein the memory can be operative to receive the information from an external processing means.

The first aspect of the invention, further, provides an apparatus wherein the memory can be operative to send the information to the external processing means.

The first aspect of the invention, further, provides an apparatus wherein the information can include medication identification, and/or dosage advice, and/or precautionary advice; and wherein the memory can be operative to store patient details.

According to a second aspect, the present invention consists in an external processor for use with apparatus for organising the taking of medication, where said apparatus comprises: an electronic clock for keeping track of the passage of time; a memory for holding information about a plurality of medications and a time or times for taking each medication; an alarm for alerting a user when said clock reaches a time for taking a medication; and a display for displaying the information concerning the medication when the time arrives to take the medication, said external processor being operative to be coupled to said memory to transfer information to said memory.

The second aspect of the invention, further, provides an external processor which can be coupled to read the information in the memory.

The second aspect of the invention, further, provides an external processor which can display the content of the memory.

The second aspect of the invention, further, provides an external processor which can analyse the content of the memory and can display any contra-indications.

The second aspect of the invention, further, provides an external processor wherein the information can include patient details.

The invention is further explained, by way of examples, by the following description, in conjunction with the appended drawings, in which.

Figure 3:
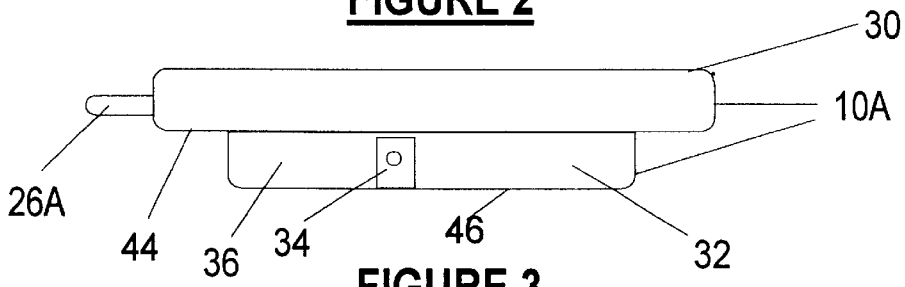
FIG. 3 is an elevated view of FIG. 2.
Figure 4:
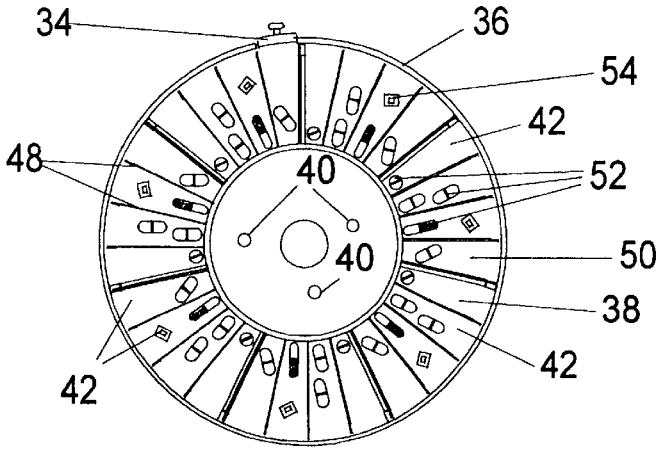

FIG. 4 a plan view of the lower member of FIG. 3

Figure 5:
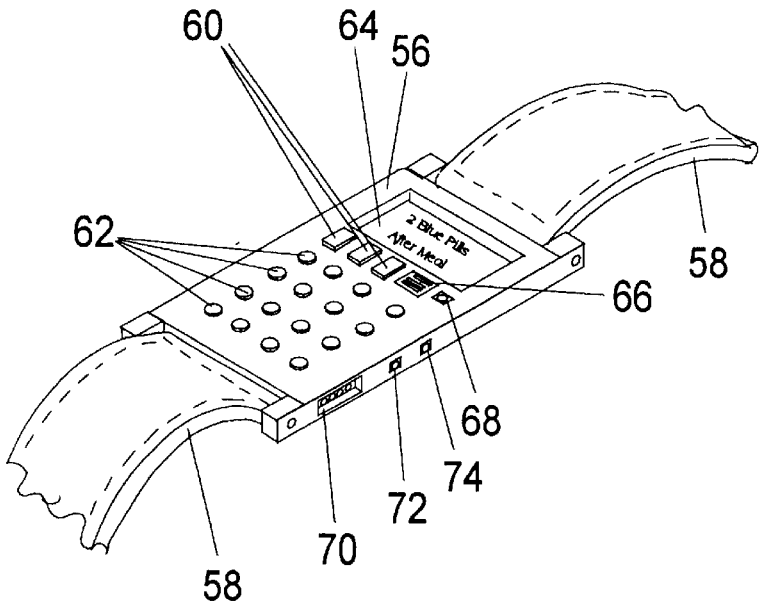

FIG. 5 is a projected view of a third, electronic, embodiment of the invention.

Figure 6:
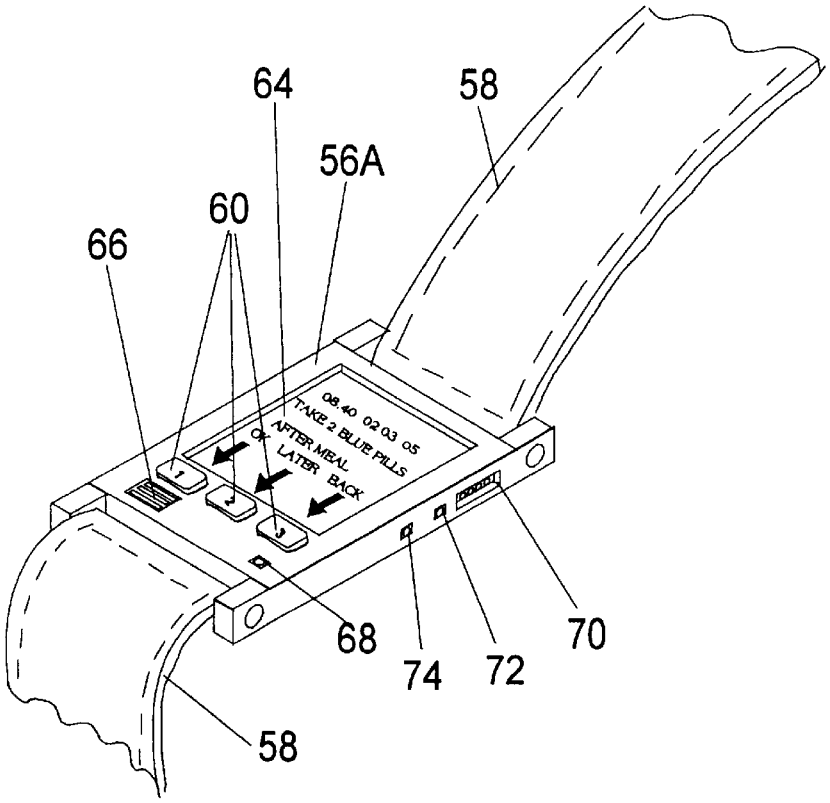

FIG. 6 is a projected view of a fourth, electronic, version of the invention, being a simplified version of the third embodiment.

Figure 7:
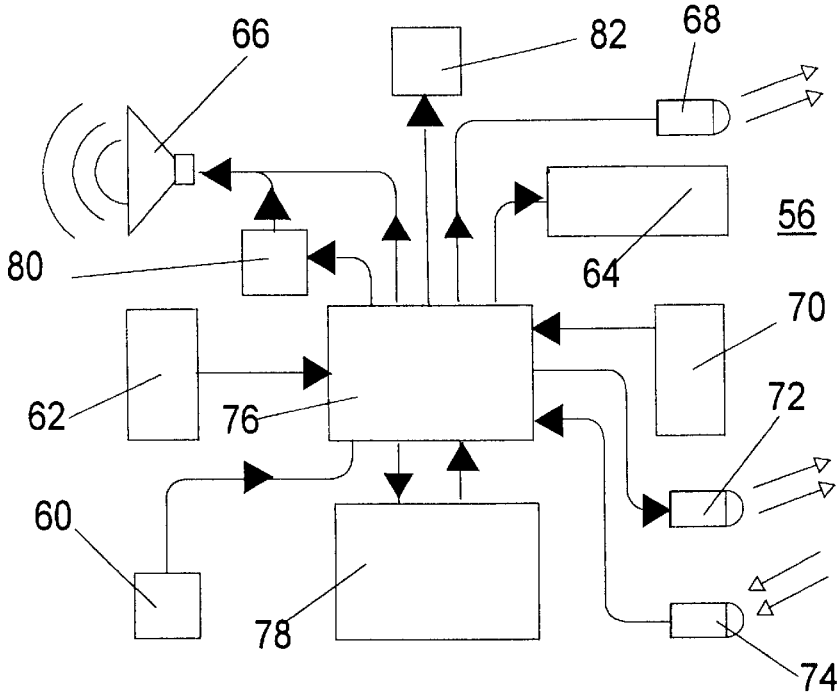

FIG. 7 is a schematic diagram of the third embodiment.

Figure 8:
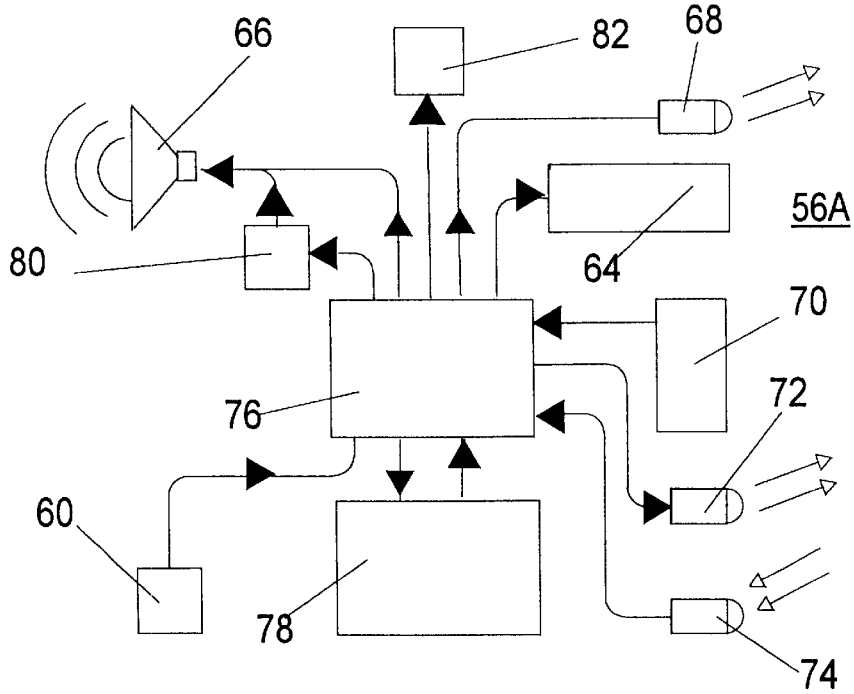

FIG. 8 is a schematic diagram of the fourth embodiment.

Figure 9:
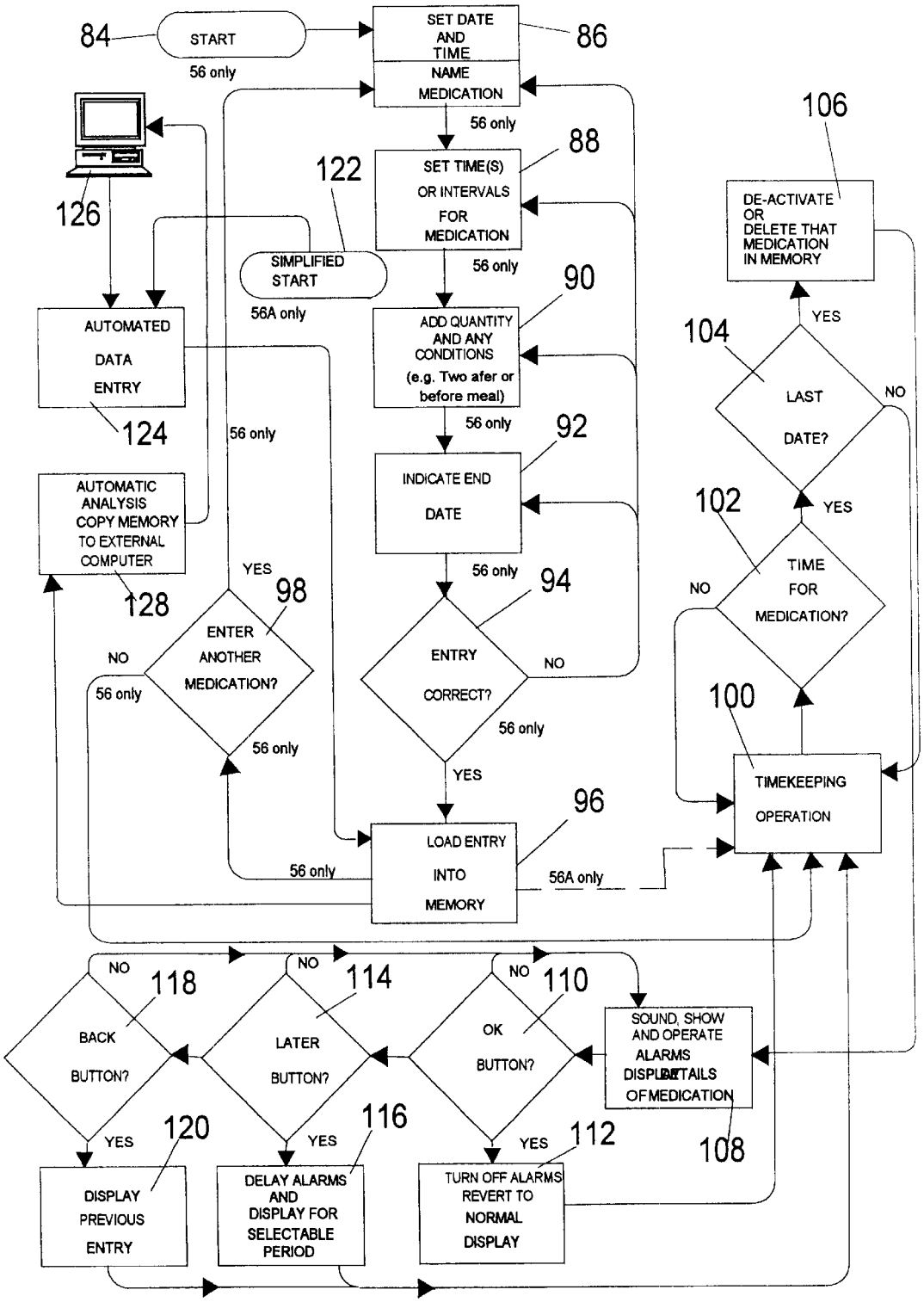

FIG. 9 is a combined flowchart, showing the activities of the third and fourth embodiments.

Figure 10:
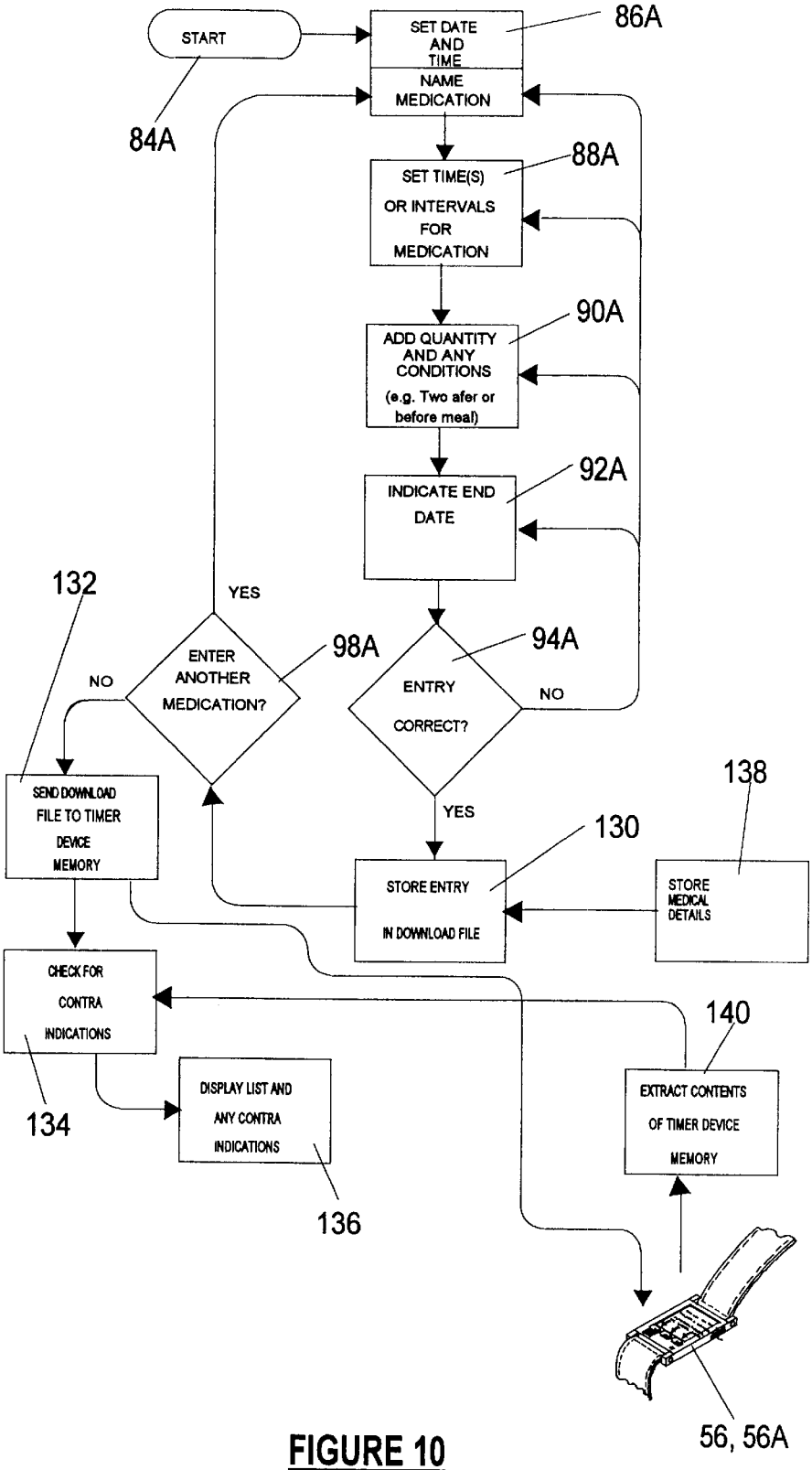
Figure 11:
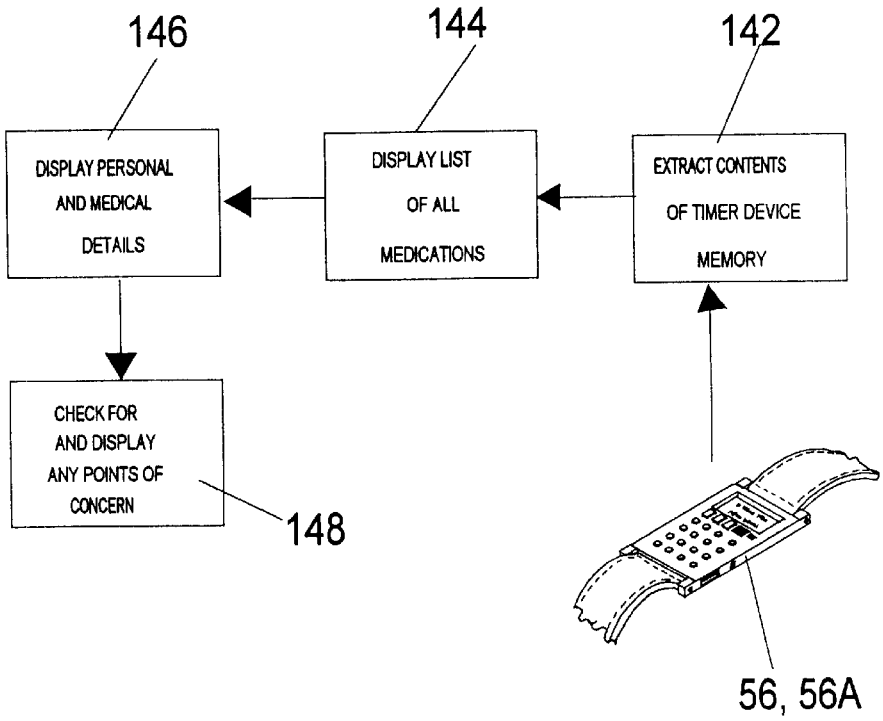

FIG. 10 is a flowchart, showing the activities of the external processor, shown in FIG. 9. And FIG. 11 is a flowchart of the activities of an external processor or simpler device, for use with the third and fourth embodiments in an emergency situation.

Figure 1:
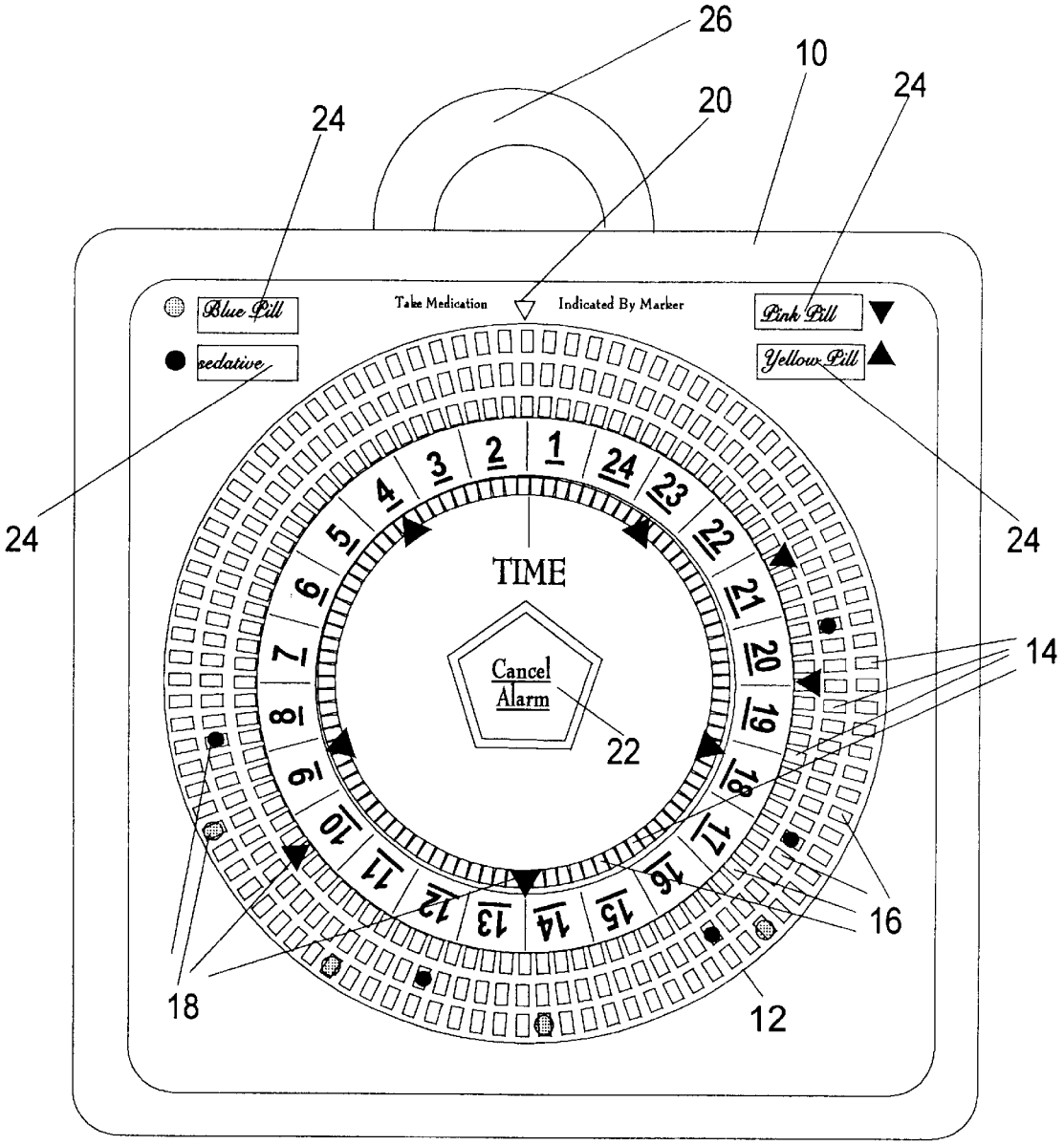
FIG. 1 is a plan view of a first, mechanical, embodiment of the invention.

Attention is drawn to FIG. 1, showing a first embodiment of the invention.

A mechanical timer unit 10 comprises a central disc 12 which rotates once in 24 hours. The disc 12 has four concentric rings 14, each, in this example, comprising ninety six angularly equispaced peg holes 16 wherein pegs 18 of different designs can be plugged to denominate any fifteen minute period of the twenty four hour day. Whenever a peg hole 16, containing a peg 18, comes into angular alignment with an index marker 20, an alarm sounds until cancelled with an alarm button 22. The different styles of pegs 18 are each representative of a particular type of medication, which is indicated on an erasable notepad adjacent to a symbol of each type of peg 18. The alarm sounding indicates that the medicines, indicated by the peg 18 or pegs 18 in alignment with the index marker 20, are to be taken.

When a medication is set up on the timer unit 10, a style of peg 18 is chosen to be representative thereof. The name of the medication (e.g. red pill, blue pill, cough syrup, or its proper name) is written on the appropriate notepad 24. The pegs 18, of the selected style, are then distributed around the clock face of the central disc 12 to be in peg holes 16 which will be in alignment with the index marker at the time the medication is to be taken.

Four rings 14 are merely one example of how this embodiment can be configured. The example shown is appropriate to regular medication taken every day. There can be fewer or more than ninety six peg holes, and more than one day can be covered. Provided no clashes occur, one ring 14 can accommodate many different styles of pegs 18. There can be a different number of styles of peg 18 than the number of rings 14.

For preference, the central disc 12 is rotated electrically, preferably by battery power, and the alarm sounded by the making of an electrical contact. Alternatively, a clockwork mechanism may be used.

To further avoid confusion, a slotted cover can be provided so that only those pegs 18, in alignment with the index marker 20, are visible. For preference, each of the styles of peg 18 has unique markings, such as Braille, whereby they may be distinguished from one another by a visually impaired person.

The timer unit 10 can be worn on the wrist, kept in a pocket, used as a badge, or hung around the neck by a chain or lanyard passing through an optional loop 26. Attention is drawn to FIG. 2, which shows a plan view of a second preferred embodiment of the invention.

Figure 2:
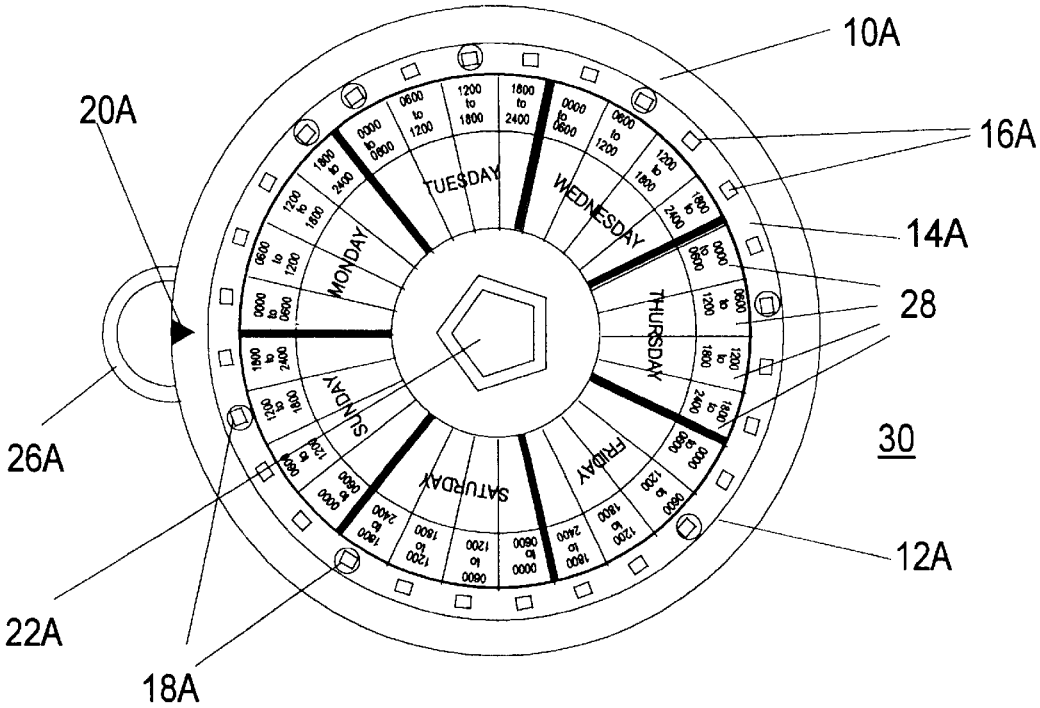
FIG. 2 is a plan view of a second, mechanical, embodiment of the invention.

Just as with the first embodiment of FIG. 1, a mechanical timer unit 10A has a central disc 12A which rotates, in this example, once every seven days, and has quarter markers 28, indicating the quarters of each day. Other periods of rotation and subdivisions of days can be chosen. A ring 14A of peg holes 16A with selection pegs 18A placed at the chosen quarter days 28 operates the alarm. An index marker 20A shows where, in the week, is the current time. As in the first embodiment, shown in FIG. 1, a plurality of rings 14A and of styles of pegs 18A can be used, if so desired. FIG. 2, being a plan view, shows only the upper member 30 of the second preferred embodiment. The embodiment of FIG. 2 further shows like items with FIG. 1, namely an alarm button 22A and a loop 26A Attention is drawn to FIG. 3, showing an elevation of FIG. 2. In addition to the upper member 30, there is shown a lower member 32, beneath the upper member 30. In the drawing, the upper member 30 is shown as being of a larger diameter than the lower member 32. It is to be understood that the lower member 32 can be of greater diameter than the upper member 30.

The lower member 32 is a circular lidless box, attached to the upper member 30 and with the upper member 30 forming the lid. A hatch 34 is provided in the side wall 36 of the lower member 32. The hatch 34 can be opened to gain access to the interior.

Attention is drawn to FIG. 4, showing a plan view of the lower member 32 with the upper member 30 removed. The side wall 36 and a bottom wall 46 (see FIG. 3) of the lower member 32 hold a circular partitioned tray 38 which is co-axially rotatable therein. The tray 38 is attached by a non-symmetrical array of pins 40 to rotate with the central disc 12A. Any attaching method can be used, so long as it ensures that the tray 38 must be in a fixed angular position, relative to the central disc 12A and rotates with the central disc 12A.

Each partition 42 of the tray 38 is formed by a pair of angularly spaced radial walls 48. As will be clear, though it is preferred that the tray 38 has a base 50, the invention also allows that the base 50 can be omitted, the "tray" 38 then becoming, effectively, a rotating paddle of radial walls 48 between the lower surface 44 of the upper member 30 and the bottom wall 46 of the lower member 32.

Each partition 42 is closed by, but free to rotate relatively to, the side wall 36 of the lower member 32, and, when the lower member 32 is attached to the upper member 30, is closed by, but free to rotate relatively to, the lower surface 44 (see FIG. 3) of the upper member 30.

As the central disc 12A rotates, so does the tray 38. There is one partition 42 for each quarter of each of the seven days of the week. As a particular quarter marker 28 comes into alignment with the index marker 20A, the respective partition 42, corresponding to that quarter marker 28, comes into alignment with the hatch 34. Each partition 42 is loaded to contain the medication 52 to be taken in the indicated quarter of the indicated day. Where a medication 52 is not in the form of a pill, tablet or capsule, which can be contained within the partition 42, a token 54 can be placed within the partition 42 to indicate, for example, an injection or a dose of liquid medicine.

When the alarm sounds, the patient cancels the alarm with the alarm button 22A. The patient then opens the hatch 34 for the appropriate medication 52 and/or reminder token 54 to be delivered for consumption or action.

Should the user fail to take the delivered medication 52 or token 54, the medication 52 or token 54 is retained within lower member 32 until the time comes for the tray 38 to be re-loaded. This feature avoids the problem of multiple dosing, since untaken medication 52 is inaccessible if not taken at the correct time and cannot be taken later, perhaps along with a properly timed dose. The person responsible for loading the tray 38 can also see what medication 52 has not been taken. For preference, the lower member 32 can be locked onto the upper member 30 so that the user does not have free access to the contents 52 54 of the tray 38.

It is also preferred that the hatch 34 cannot be opened to allow the user access to more than one partition 42 at once. To this end, it is preferred that the hatch 34 is only large enough to permit access to one partition 42 at a time and is only able to be opened, because of the action of a mechanical or electro-mechanical latch, when only a single partition is accessible.

Another variant on the second embodiment of the invention has the lower member 32 permanently fixed to the upper member 30, the tray 38 being loaded and unloaded through the hatch 34. The central disc 12A can be freed to be rotated, using an unlocking key, by the person responsible for loading the tray. This feature has the advantage that, since the quarter day being loaded or unloaded is clearly visible against the index marker 20A, there is little chance of medication 52 being placed in an incorrect partition 42. It is preferred that the tray 38 and side wall 36 and bottom wall 46 of the lower member 32 are made of transparent material so that the contents of each partition 42 can be visually checked.

Attention is drawn to FIG. 5, showing a projected view of a third embodiment of the invention. The third embodiment is an electronic version of the first embodiment, shown in FIG. 1, with added features which stem from its electronic implementation.

An electronic timer unit 56 is provided in the general form of a wristwatch, held onto the wrist by straps 58. The electronic timer unit 56 comprises response buttons 60 whereby the user can respond to an alarm. Control buttons 62 enable the user to set up alarm times and indications for the electronic timer unit 56. An alphanumeric display 64 displays time and alarm information. A sounder 66 sounds in an alarm and can deliver voice replications of data, on the display 64. A visible light emitting diode (LED) flashes during an alarm.

A connector 70 is provided for the electronic timer unit 56 to receive data from or send data to an external computer. Optionally, or additionally, a transmitting infrared light emitting diode 72 can be used to send serial data to the external computer and a receiving infrared photo transistor 74 can be used to receive serial data from the external computer.

Attention is drawn to FIG. 6, a fourth embodiment of the invention, in the form of a simplified electronic timer unit 56A, is shown. In the simplified electronic timer unit 56A, the control buttons 62 are omitted and only the response buttons 60 are provided. Everything else is the same as the electronic timer unit 56 shown in FIG. 5.

Whereas the user and/or the external computer can programme the electronic timer unit 56 of FIG. 5, the simplified electronic timer unit 56A of FIG. 6 can only be programmed by the external computer. The user cannot, therefore, tamper with the settings. The simplified electronic timer unit 56A is therefore appropriate for children, psychiatrically disturbed persons, persons with reasoning difficulties, persons of failing sight, persons lacking digital dexterity, blind persons, and persons in clinical trials. The doctor, pharmacist or research scientist will program the simplified electronic timer unit 56A on behalf of the patient or subject, who will then be unable to alter the settings.

Attention is drawn to FIG. 7 and FIG. 8, showing, respectively, a schematic block diagram of the electronic timer unit 56 of FIG. 5 and a schematic block diagram of the simplified electronic timer unit 56A of FIG. 6. Like numbers correspond to like elements in all of FIGS. 5, 6, 7 and 8.

A timer unit processor 76 co-operates with a timer unit memory 78. The timer unit processor 76 provides input to the display 64, the visible light emitting diode 68, the transmitting infrared light emitting diode 72, a voice synthesiser 80 and the sounder 66. In addition, the timer unit processor 76 can drive a vibrator unit 82, usable as an alarm for deaf persons, and for other persons when the sounder 66 would prove inconvenient. The vibrator unit 82 is held within the case and not shown in FIG. 5 or FIG. 6. The voice synthesiser 80, in its turn, drives the sounder 66.

The timer unit processor 76 receives input from the control buttons 62 (not present in FIG. 8 or FIG. 6)), the response buttons 60, the connector 70 and the receiving infrared photo transistor 74.

Attention is drawn to FIG. 9, showing a flowchart of the activities of the electronic timer units 56 56A.

Entry, 84 for the electronic timer unit 56, is to a first operation 86 where, using the control buttons 62, the user enters the date and time, if required, and then enters an identifier for a particular medication. It could be the correct name, or a simple descriptor such as "red pill", "capsule" or, for the blind, "large round pill" and so on.

For preference, to garner an unexpected advantage, which will become apparent from the description, hereafter, of FIG. 10 and FIG. 11, the correct name (medical identifier, trade name or other information whereby the true chemical content and dosage of the medication can be known), is also included, but not necessarily displayed at the time of taking the medication.

A second operation 88 then has the times, or time intervals, set for the taking of that medication. A third operation 90 then has the caveat added. This consists of the quantity to be taken and any conditions to be met. An entry might be "two tablets, after meal" or "1 pill, before bed" and so on. A fourth operation 92 then has the end date set when the medication no longer needs to be taken. No end date means there is no limit to how long a medication will require to be taken.

If a first test 94 finds that the entry is not correct, as indicated by the user/programmer on the control buttons 62, the user can return to the appropriate operation 86 88 90 92 to correct that entry. If the first test 94 finds that the entry is correct, a fifth operation loads the entry into the timer unit memory 78.

A second test 98 then looks for a user/programmer response as to whether or not another medication is to be added. If another medication is to be added, control is passed back to the first operation 86 and the entry loop is restarted. If another medication is not to be added, control passes to a sixth operation 100 where the normal activity of keeping track of time is undertaken.

A third test 102 checks to see if the time has come to take a medication. If the time has come, a fourth test 104 checks to see if time has run past the end date entered in the fourth operation 92. If it has, a seventh operation 106 deletes or deactivates the indicated medication in the timer unit memory 78 and control is passed back to the timekeeping activity of the sixth operation 100. If it has not, control passes to an eighth operation 108 where the required alarms 66 82 68 are activated and the required action is indicated on the display 64 and encoded via the voice synthesiser 80 for the benefit of blind persons. The user can then operate one of the response buttons 60.

If a fifth test 110 detects that an "OK" button has been pressed, indicating that the user has complied with the requirements, a ninth operation 112 turns off the alarms, reverts the display/synthesised voice to normal (usually, just time and date), and returns control to the timekeeping activities of the sixth operation 100.

If a sixth test 114 detects that a "LATER" button has been pressed, a tenth operation 116 delays the operation of the alarms 82 68 66 and the display 64/voice synthesis 80 of information for a set period, which can be chosen by the user/programmer, or be predetermined. The timekeeping sixth operation 100 will return control to the fifth operation 108 after the delay, to repeat the alarm activation and indication that a medication should be taken.

If a sixth test 116 finds that a "BACK" button has been pressed, an eleventh operation 120 displays/voice synthesises the previous entry, to remind the user what should have happened. Control passes back to the sixth operation 100, in this example, though it is in the invention that the "BACK" button can be pressed at any time.

The response button 60 tests 100 114 118 and operations 112 116 120 are simply exemplary of one way in which a response can be made to an alarm or lack of an alarm. The invention includes other responses and different numbers of response buttons 60.

The control button 62 entry operations 86 88 90 92 94 and the associated tests 96 98 are all unique to the electronic timer unit 56 of FIG. 5 and FIG. 7, and are not to be found in the simplified electronic timer unit 56A of FIG. 6 and FIG. 8.

In both the simplified electronic timer unit 56A (from a simplified start 122) and the timer unit 56, provision is made for automated data entry in a twelfth operation 124, which takes data, via the connector 70 or the receiving infrared photo transistor 74, from an external data source, such as an external computer 126, and transfers that data to the timer unit memory 78 via the fifth operation 96. Thus, a pharmacist, doctor or research scientist can load the timer unit 56 56A.

In both the simplified electronic timer unit 56A and the timer unit 56, provision is made for automated data download in a thirteenth operation 128. The contents of the timer unit memory 78 are sent, via the connector 70 or the transmitting infrared light emitting diode 72, to the external computer 126. As will be seen this imparts a considerable advantage, in medical safety terms.

In the fifth operation 96, it is preferred that data for a new medication is stored in addition to data for any existing medications, and that medications, which have run past their end date, should remain on the memory 78, for at least a set period, or until they are deliberately erased. This also has a surprising beneficial effect, as will be explained in relation to FIG. 10 and FIG. 11.

Attention is now drawn to FIG. 10, showing the activity of the external computer 126 when interactive with the electronic timer unit 56 or the simplified electronic timer unit 56A. Similar operations have similar numbers in FIGS. 9 and 10.

Computer start 84A, first to fourth operations 84A 86A 88A 90A 92A and first and second tests 94A 98A are exactly the same as performed in FIG. 9 for the electronic timer unit 56, with the exception that the computer 126 keyboard is used instead of the control buttons 62. In this manner, the computer 126 assembles a download file in a fourteenth operation 130. When the second computer test 98A detects that there are no more medications to be added to the download file, a fifteenth operation 132 downloads the assembled download file to the electronic timer unit 56 56A.

The utility of knowing a list of medications, times and doses becomes apparent when a sixteenth operation 134 checks the downloaded list for contra indications. Some doses of medications are questionably dangerous or simply lethally wrong. Some combinations of medications are far from beneficial to the patient. In the sixteenth operation, the computer 126 checks against a database of medications and conditions to see if any questionable combinations or dose sizes for the patients condition (if known) have, inadvertently, been bought by the patient for self administration or prescribed, or accidentally included in the download file. This provides a safeguard against errors by the prescriber, the pharmacist and the patient. After the sixteenth operation 134, a seventeenth operation 136 displays the list of medications, and lists the computer's 126 concerns. Appropriate action can then be taken to rectify any problems which seem to have arisen.

An eighteenth operation 138 can store patient and medical details, to be added to the download file for storage in the electronic timer unit 56 56A memory 78. Such details as name, age, address, blood group, known medical or psychiatric conditions, next of kin, and so on, can be fed to the fourteenth operation 130 for downloading to the electronic timer unit 56 56A. The electronic timer unit 56, preferably, also can store such information by use of the control keys 62.

Another powerful utility arises from a nineteenth operation 140 which extracts the content of the memory 78 in the electronic timer unit 56 56A and feeds it to the sixteenth operation 134. Since the data in the electronic timer unit 56 56A memory 78 contains the whole of the medications being taken, and having recently been taken, by the patient, together with medical details, the computer 126 is able to make a very powerful analysis of any potential risks. Patients may have been prescribed medication by more than one doctor, who have no knowledge of what the other(s) have prescribed. Only here, in the computer 126, does the whole story come together.

Attention is now drawn to FIG. 11, showing a situation where the utility of the electronic timer unit 56 56A is even more apparent.

Imagine that a patient is found in a state of incoherent collapse or unconsciousness. A computer, or similar device, or a smaller device (for ambulances) in an emergency vehicle, a surgery or emergency hospital admissions department, in a twentieth operation 142, extracts the contents of the memory 78 in the electronic timer unit 56 56A and displays the list of medications, doses etc, as well as the patient's personal and medical details in a twenty-first operation 144 and a twenty-second operation 146. The information is then available for medical staff to make informed diagnoses and for administrative staff to process the patient in a more meaningful way. If the computer or similar machine is powerful enough, or powerfully enough connected, a twenty third operation 148 can then check all of the information and display concerns, or, with extra input as to the instant condition of the patient, even suggest treatments.

What is claimed is:

1. An apparatus for organising the taking of medication, said apparatus comprising: clock means, for keeping track of the passage of time; selection means, for selecting a time when a medication is to be taken; alarm means, for alerting a user when said clock means reaches the selected time; and indication means, for identifying the medication to be taken said indication means comprising a peg; and said selection means comprising a plurality of peg holes for selective insertion of the peg to select a selected time; said clock means being operative to move said plurality of peg holes to bring the inserted peg into a position actuating said alarm means for said alarm means to alert a user at said selected time.

2. An apparatus, according to claim 1, wherein the medication is one of a plurality of medications, wherein said selected time is one of a plurality of selected times, and wherein the peg is one of a plurality of pegs of different styles, each style being to identify which of said plurality of medications is to be taken at each instance of operation of said alarm means.

3. An apparatus according to claim 1 or claim 2, wherein said indication means includes dispensing means, operative to deliver the medication to be taken at the operation of said alarm means.

4. An apparatus, according to claim 3, wherein said dispensing means is operative to retain medication that is not taken at the selected time.

5. An apparatus, according to claim 1 or claim 2, wherein said clock means is mec/hanical and operative to move said plurality of peg holes in at least one concentric circular path.

6. An apparatus, according to claim 1 or claim 2, wherein said clock means is electro-mechanical and operative to move said plurality of peg holes in at least one concentric circular path.

7. An apparatus, according to claim 2, wherein said peg holes accept selectively a plurality of different styles of peg to select a respective time.

8. An apparatus, according to claim 1 or claim 2, wherein said indication means is operative to receive a plurality of different styles of peg to select any one particular time.

9. An apparatus, according to claim 3, wherein said clock means is mechanical and operative to move said plurality of peg holes in at least one concentric circular path.

10. An apparatus, according to claim 4, wherein said clock means is mechanical and operative to move said plurality of peg holes in at least one concentric circular path.

11. An apparatus, according to claim 3, wherein said clock means is electro-mechanical and operative to move said plurality of peg holes in at least one concentric circular path.

12. An apparatus, according to claim 4, wherein said clock means is electro-mechanical and operative to move said plurality of peg holes in at least one concentric circular path.

13. An external processor for use with apparatus for organising the taking of medication, where said apparatus comprises: an electronic clock for keeping track of the passage of time; a memory for holding information about patient details and a plurality of medications and a time or times for taking each medication; an alarm for alerting a user when said clock reaches a time for taking a medication; and a display for displaying the information concerning the medication when the time arrives to take the medication, said external processor being operative to read the information in said memory; said external processor being operative to analyse the content of said memory; and said external processor being operative to display any contra-indications found by the analysis.

14. An external processor, according to claim 13, operative to transfer information to said memory.

15. An external processor, according to claim 14, operative to display the content of said memory.

* * * * *